US009932767B2

(12) United States Patent
Matsuo et al.

(10) Patent No.: US 9,932,767 B2
(45) Date of Patent: Apr. 3, 2018

(54) FIRE DOOR

(71) Applicants: Krosaki Harima Corporation, Kitakyushu-shi (JP); Daifuku Co., Ltd., Osaka-shi (JP)

(72) Inventors: Yukihisa Matsuo, Kitakyushu (JP); Kouji Yasuda, Kitakyushu (JP); Yoshihiro Hosaka, Komaki (JP); Naoki Kawabe, Tokyo (JP); Nobuo Ogawa, Tokyo (JP)

(73) Assignee: Daifuku Co., Ltd., Osaka-shi (JP)

( * ) Notice: Subject to any disclaimer, the term of this patent is extended or adjusted under 35 U.S.C. 154(b) by 0 days.

(21) Appl. No.: 15/667,850

(22) Filed: Aug. 3, 2017

(65) Prior Publication Data

US 2018/0038157 A1 Feb. 8, 2018

(30) Foreign Application Priority Data

Aug. 5, 2016 (JP) ..... 2016-154594

(51) Int. Cl.
*E06B 5/16* (2006.01)
*E06B 3/70* (2006.01)
(Continued)

(52) U.S. Cl.
CPC ..... *E06B 5/16* (2013.01); *E06B 3/70* (2013.01); *E06B 3/00* (2013.01); *E06B 5/00* (2013.01); *E06B 2003/7078* (2013.01)

(58) Field of Classification Search
CPC ..... E06B 5/16; E06B 3/70; E06B 3/00; E06B 5/00; E06B 2003/7078; E06B 5/20;
(Continued)

(56) References Cited

U.S. PATENT DOCUMENTS 8,573,357 B1 * 11/2013 Hibbs ..... E06B 5/20 181/287
2004/0163571 A1 * 8/2004 Fortin ..... E06L 33/7015 106/605

(Continued)

FOREIGN PATENT DOCUMENTS

JP 2009137675 A 6/2009

*Primary Examiner* — Beth A Stephan
(74) *Attorney, Agent, or Firm* — The Webb Law Firm

(57) ABSTRACT

A fire door includes an intermediate member formed in the shape of a plate and arranged between a first plate member and a second plate member; a first heat insulating material arranged between the first plate member and the intermediate member; a second heat insulating material arranged between the second plate member and the intermediate member; a first coupling member for coupling the first plate member and the intermediate member, arranged so as to extend through the first heat insulating material; and a second coupling member for coupling the second plate member and the intermediate member, arranged so as to extend through the second heat insulating material. The first coupling member is arranged so as to be spaced away from both of the second plate member and the second coupling member. The second coupling member is arranged so as to be spaced away from the first plate member, and the first plate member and the second plate member are arranged so as to be spaced away from each other.

8 Claims, 6 Drawing Sheets

(51) Int. Cl.
*E06B 5/00* (2006.01)
*E06B 3/00* (2006.01)

(58) Field of Classification Search
CPC ..... E06B 2003/7051; E06B 3/7015; E06B 2003/7042
See application file for complete search history.

(56) References Cited

U.S. PATENT DOCUMENTS

| | | | | |
|---|---|---|---|---|
| 2004/0226245 | A1* | 11/2004 | Clark | B32B 5/22 52/455 |
| 2006/0248833 | A1* | 11/2006 | Autovino | E06L 33/72 52/455 |
| 2014/0000193 | A1* | 1/2014 | Daniels | E06B 3/822 52/232 |
| 2014/0047785 | A1* | 2/2014 | Wilkinson | E06B 3/827 52/232 |
| 2014/0370215 | A1* | 12/2014 | Collison | B32B 5/26 428/36.2 |
| 2015/0033646 | A1* | 2/2015 | Baumert | E06B 5/164 52/232 |

* cited by examiner

FIRE DOOR

CROSS-REFERENCE TO RELATED APPLICATION

This application claims priority to Japanese Patent Application No. 2016-154594 filed Aug. 5, 2016, the disclosure of which is hereby incorporated in its entirety by reference.

BACKGROUND OF THE INVENTION

1. Field of the Invention

The present invention relates to a fire door.

2. Description of the Related Art

Fire doors are typically provided so as to be capable of opening and closing opening portions formed in buildings, facilities, or the like. When a fire breaks out, spread of the fire via the opening portions can be suppressed by closing the opening portions with the fire doors. For example, JP 2009-137675A (Patent Document 1) discloses a technique for providing a fire door so as to be capable of opening and closing an opening portion of a floor portion forming a lifting/lowering route of a lifting/lowering body, in a facility where the lifting/lowering route is formed over a plurality of floors. If such a fire door is provided, when a fire breaks out on one floor, spread of the fire to another floor can be suppressed.

SUMMARY OF THE INVENTION

However, in Patent Document 1, there is no description of heat insulating performance (heat shielding performance) of the fire door. If the heat shielding performance is low, heat conduction from the side exposed to fire (the side of the fire door on which a fire has broken out, which is hereinafter referred to as a "fire side") to the rear face side thereof (hereinafter, referred to as a "non-fire side") is large, and thus the fire may spread to the non-fire side due to inflammables on that side catching and generating fire. Thus, it is preferable that fire doors have excellent heat shielding performance in addition to excellent flame shielding performance and smoke shielding performance.

Thus, there is a recent demand for a fire door capable of properly ensuring heat shielding performance.

The present disclosure is directed to a fire door including: a first plate member formed in the shape of a plate; a second plate member formed in the shape of a plate and arranged so as to be laid over the first plate member as viewed in a plate thickness direction; and an intermediate member formed in the shape of a plate and arranged between the first plate member and the second plate member; a first heat insulating material arranged between the first plate member and the intermediate member; a second heat insulating material arranged between the second plate member and the intermediate member; a first coupling member for coupling the first plate member and the intermediate member, arranged so as to extend through the first heat insulating material; and a second coupling member for coupling the second plate member and the intermediate member, arranged so as to extend through the second heat insulating material; wherein the first coupling member is arranged so as to be spaced away from both of the second plate member and the second coupling member, the second coupling member is arranged so as to be spaced away from the first plate member, and the first plate member and the second plate member are arranged so as to be spaced away from each other.

With this configuration, the first plate member is coupled by the first coupling member to the intermediate member, and the second plate member is coupled by the second coupling member to the intermediate member, and thus the first plate member and the second plate member can be coupled to each other via the intermediate member arranged therebetween, without using a direct coupling member for directly coupling the first plate member and the second plate member. That is to say, if a direct coupling member is used, the direct coupling member may be a thermal bridge between the first plate member and the second plate member, resulting in a decrease in the thermal resistance between the first plate member and the second plate member, and further in a decrease in the heat shielding performance of the fire door. However, with the above-described configuration, the first plate member and the second plate member can be coupled to each other without using such a direct coupling member. Furthermore, with the above-described configuration, the first coupling member is arranged so as to be spaced away from both of the second plate member and the second coupling member, and the second coupling member is arranged so as to be spaced away from the first plate member, and, moreover, the first plate member and the second plate member are arranged so as to be spaced away from each other. Accordingly, heat conduction due to contact between the first plate member and the second plate member can be avoided, and formation of heat conductive paths having a low thermal resistance connecting the first plate member and the second plate member, via the first coupling member or the second coupling member, can be suppressed. As a result, the thermal resistance between the first plate member and the second plate member can be a relatively high value according to the thermal resistances of the first heat insulating material and the second heat insulating material.

As described above, according to this configuration, the first plate member and the second plate member can be coupled to each other while ensuring a high thermal resistance between the first plate member and the second plate member, as a result of which it is possible to realize a fire door whose heat shielding performance can be properly ensured.

DESCRIPTION OF THE PREFERRED EMBODIMENTS

Hereinafter, an embodiment of a fire door will be described with reference to the drawings.

Figure 1:
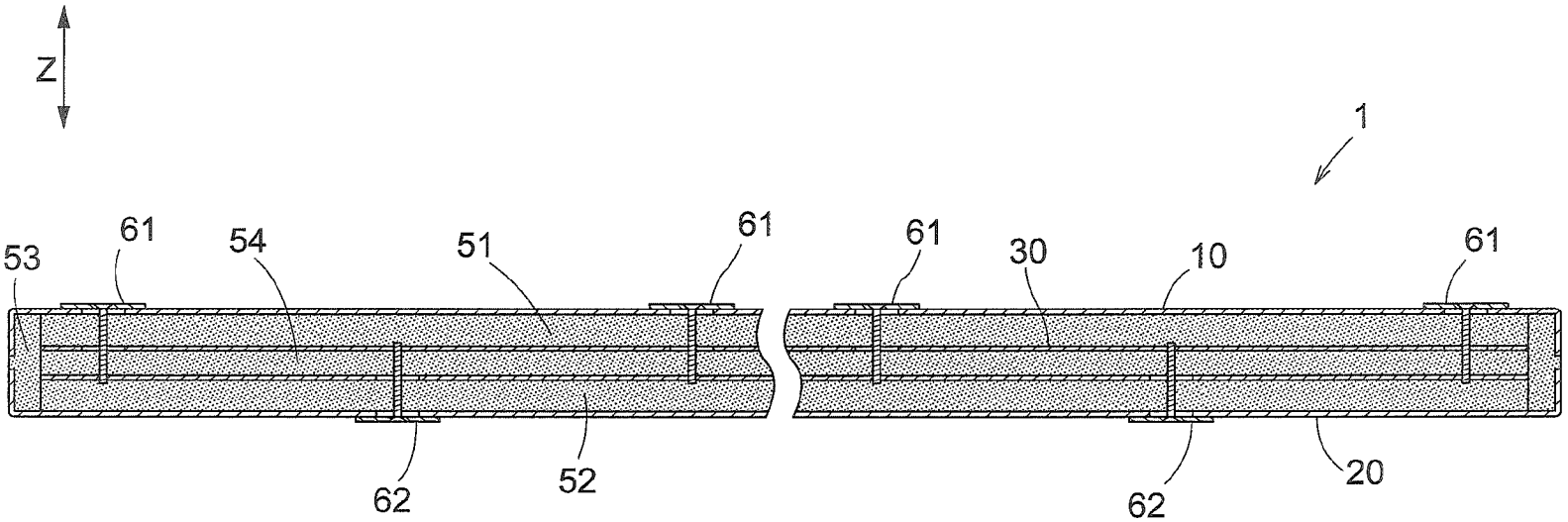
FIG. 1 is a cross-sectional view of a fire door according to an embodiment.

As shown in FIG. 1, a fire door 1 includes a first plate member 10 formed in the shape of a plate, and a second plate member 20 formed in the shape of a plate and arranged so as to be laid over the first plate member 10 as viewed in a plate thickness direction Z. In this embodiment, the first plate member 10 and the second plate member 20 are formed in the same shape as viewed in the plate thickness direction Z (i.e., in plan view), and are arranged so as to be completely laid over each other as viewed in the plate thickness direction Z. Note that the plate thickness direction Z is a thickness direction of the fire door 1 formed as a whole in the shape of a plate (a direction that is orthogonal to the plate face). If the fire door 1 is formed as a whole in the shape of a curved plate or formed in the shape of a plate that can be bent for rolling, for example, the plate thickness direction Z can be individually set at each position. In this embodiment, the fire door 1 is formed as a whole in the shape of a flat plate. Furthermore, in this embodiment, the fire door 1 is not flexible enough to be bent. As the first plate member 10 and the second plate member 20, plates made of fire-resistant materials may be used. Examples of the fire-resistant materials include metal materials such as stainless steel, iron, and aluminum.

The fire door 1 includes an intermediate member 30 formed in the shape of a plate and arranged between the first plate member 10 and the second plate member 20, a first heat insulating material 51 arranged between the first plate member 10 and the intermediate member 30, and a second heat insulating material 52 arranged between the second plate member 20 and the intermediate member 30. In this embodiment, the first plate member 10, the second plate member 20, and the intermediate member 30 are each formed in the shape of a flat plate. The first plate member 10, the second plate member 20, and the intermediate member 30 are arranged parallel to each other. Thus, in this embodiment, the first heat insulating material 51 is arranged at a heat insulating layer in the shape of a flat plate formed between the first plate member 10 and the intermediate member 30, and the second heat insulating material 52 is arranged at a heat insulating layer in the shape of a flat plate formed between the second plate member 20 and the intermediate member 30. Furthermore, in this embodiment, the plate thickness direction of each of the first plate member 10, the second plate member 20, and the intermediate member 30 matches the plate thickness direction Z of the fire door 1 as a whole. As described later, in this embodiment, the intermediate member 30 includes two intermediate plate members 40 (a first intermediate plate member 41 and a second intermediate plate member 42) arranged so as to be spaced away from each other in the plate thickness direction Z, and an intermediate heat insulating material 54 arranged between the two intermediate plate members 40 (see FIG. 2).

As the first heat insulating material 51 and the second heat insulating material 52, heat insulating materials shaped into a plate shape (a flat plate shape, in this example) may be used. As the first heat insulating material 51 and the second heat insulating material 52, heat insulating materials having a low thermal conductivity (having a high thermal resistance) are preferably used, and, for example, heat insulating materials having a thermal conductivity lower than that of still air may be used. Examples of the heat insulating materials having a thermal conductivity lower than that of still air include microporous heat insulating materials having a microporous structure including fine voids with a size of 100 nm or less mainly made of an ultra fine powder with a particle size of 5 to 30 nm (e.g., fumed silica powder).

The fire door 1 includes a first coupling member 61 for coupling the first plate member 10 and the intermediate member 30, arranged so as to extend through the first heat insulating material 51, and a second coupling member 62 for coupling the second plate member 20 and the intermediate member 30, arranged so as to extend through the second heat insulating material 52. That is to say, the first plate member 10 and the second plate member 20 are coupled to each other via the intermediate member 30. If a coupling member for directly coupling the first plate member 10 and the second plate member 20 (hereinafter, referred to as a "direct coupling member") is used, the direct coupling member may be a thermal bridge between the first plate member 10 and the second plate member 20, but the configuration in which the first plate member 10 and the second plate member 20 are coupled to each other via the intermediate member 30 makes it unnecessary to use such a direct coupling member. In this embodiment, the fire door 1 includes a plurality of first coupling members 61 and a plurality of second coupling members 62. As the first coupling members 61 and the second coupling members 62, for example, coupling members made of metal materials such as stainless steel and coupling members made of ceramics may be used.

Figure 2:
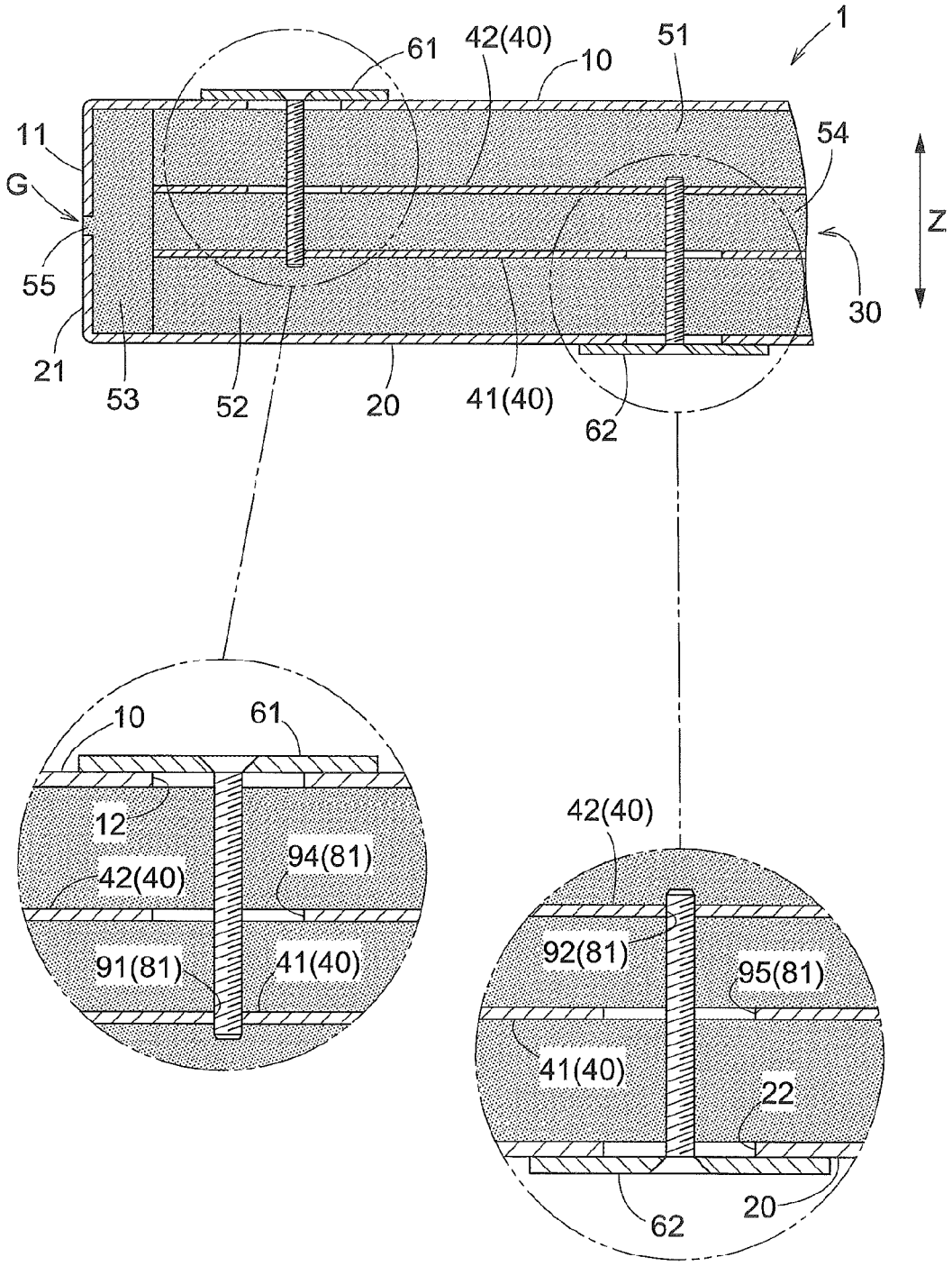
FIG. 2 is a cross-sectional view of part of the fire door according to the embodiment.

As shown in FIG. 2, in this embodiment, each first coupling member 61 is a male screw including a head with a diameter larger than that of a first through hole 12 formed so as to extend through the first plate member 10 in the plate thickness direction Z, and a shank that is to be fastened to a first fastening hole 91 formed at the intermediate member 30. In this embodiment, the first fastening hole 91 is formed at the later-described first intermediate plate member 41. In the first heat insulating material 51, a through hole into which the shank of the first coupling member 61 is to be inserted is formed so as to extend through the first heat insulating material 51 in the plate thickness direction Z, and the first coupling member 61 is fastened to the first fastening hole 91 in a state of being inserted into the first through hole 12 and the through hole formed through the first heat insulating material 51 from the side opposite to the intermediate member 30 in the plate thickness direction Z. That is to say, the first plate member 10 and the intermediate member 30 are coupled to each other by the first coupling member 61 and the first fastening hole 91 being fastened each other, in a state where the first heat insulating material 51 is interposed between the first plate member 10 and the intermediate member 30. Accordingly, the first plate member 10 is fixed relative to the intermediate member 30 such that the distance in the plate thickness direction Z from the intermediate member 30 (the distance in the plate thickness direction Z from the second intermediate plate member 42, in this embodiment) is a first distance according to the plate thickness (the width in the plate thickness direction Z) of the first heat insulating material 51 (a distance that is equal to or larger than the plate thickness of the first heat insulating material 51). Note that the second heat insulating material 52 is provided, at a portion thereof facing the first fastening hole 91 in the plate thickness direction Z, with a recess that is recessed toward the side opposite from the first fastening hole 91, and the front end (screw end) of the shank of the first coupling member 61 is inserted into the recess. If the mechanical strength of the first heat insulating material 51 is not enough to maintain the distance between the first plate member 10 and the intermediate member 30, the distance between the first plate member 10 and the intermediate member 30 may be kept at the first distance, for example, by using spacers (first spacers 71) for maintaining the distance between the first plate member 10 and the intermediate member 30 as in the example shown in FIG. 4 described later.

Furthermore, as shown in FIG. 2, in this embodiment, each second coupling member 62 is a male screw including a head with a diameter larger than that of a second through hole 22 formed so as to extend through the second plate member 20 in the plate thickness direction Z, and a shank that is to be fastened to a second fastening hole 92 formed at the intermediate member 30. In this embodiment, the second fastening hole 92 is formed at the later-described second intermediate plate member 42. In the second heat insulating material 52, a through hole into which the shank of the second coupling member 62 is to be inserted is formed so as to extend through the second heat insulating material 52 in the plate thickness direction Z, and the second coupling member 62 is fastened to the second fastening hole 92 in a state of being inserted into the second through hole 22 and the through hole formed through the second heat insulating material 52 from the side opposite to the intermediate member 30 in the plate thickness direction Z. That is to say, the second plate member 20 and the intermediate member 30 are coupled to each other by the second coupling member 62 and the second fastening hole 92 being fastened each other, in a state where the second heat insulating material 52 is interposed between the second plate member 20 and the intermediate member 30. Accordingly, the second plate member 20 is fixed relative to the intermediate member 30 such that the distance in the plate thickness direction Z from the intermediate member 30 (the distance in the plate thickness direction Z from the first intermediate plate member 41, in this embodiment) is a second distance according to the plate thickness (the width in the plate thickness direction Z) of the second heat insulating material 52 (a distance that is equal to or larger than the plate thickness of the second heat insulating material 52). Note that the first heat insulating material 51 is provided, at a portion thereof facing the second fastening hole 92 in the plate thickness direction Z, with a recess that is recessed toward the side opposite from the second fastening hole 92, and the front end (screw end) of the shank of the second coupling member 62 is inserted into the recess. If the mechanical strength of the second heat insulating material 52 is not enough to maintain the distance between the second plate member 20 and the intermediate member 30, the distance between the second plate member 20 and the intermediate member 30 may be kept at the second distance, for example, by using spacers (second spacers 72) for maintaining the distance between the second plate member 20 and the intermediate member 30 as in the example shown in FIG. 4 described later.

As shown in FIG. 2, in this embodiment, the intermediate member 30 includes the plurality of intermediate plate members 40, which are a plurality of members each formed in the shape of a plate, arranged so as to be spaced away from each other in the plate thickness direction Z, and the intermediate heat insulating material 54 arranged between two intermediate plate members 40 adjacent to each other in the plate thickness direction Z. That is to say, the intermediate plate members 40 are arranged respectively at both ends in the plate thickness direction Z of the intermediate member 30, and the intermediate heat insulating material 54 is arranged at each heat insulating layer formed between two intermediate plate members 40 adjacent to each other in the plate thickness direction Z. In this embodiment, the intermediate plate members 40 are each formed in the shape of a flat plate. The plurality of intermediate plate members 40 are arranged parallel to each other. As the intermediate plate members 40, for example, plates made of metal materials such as stainless steel, iron, and aluminum may be used. As the intermediate plate members 40, plates made of the same material as that for the first plate member 10 and the second plate member 20 also may be used. Furthermore, as the intermediate heat insulating material 54, a heat insulating material shaped into a plate shape (a flat plate shape, in this example) may be used. As the intermediate heat insulating material 54, a heat insulating material having a low thermal conductivity (having a high thermal resistance) is preferably used, and, for example, a heat insulating material made of the same material as and having the same structure as that of the first heat insulating material 51 and the second heat insulating material 52 may be used.

In this embodiment, the intermediate member 30 includes two intermediate plate members 40. The first coupling members 61 couple the first intermediate plate member 41, which is one of the intermediate plate members 40, and the first plate member 10, and the second coupling members 62 couple the second intermediate plate member 42, which is the other intermediate plate member 40 different from the first intermediate plate member 41, and the second plate member 20. In this embodiment, the second intermediate plate member 42 is arranged between the first plate member 10 and the first intermediate plate member 41 in the plate thickness direction Z. Thus, as shown in FIG. 2, in the first intermediate plate member 41, the second intermediate through holes 95 into which the shanks of the second coupling members 62 are to be inserted are formed so as to extend through the first intermediate plate member 41 in the plate thickness direction Z, and, in the second intermediate plate member 42, the first intermediate through holes 94 into which the shanks of the first coupling members 61 are to be inserted are formed so as to extend through the second intermediate plate member 42 in the plate thickness direction Z. Furthermore, in the intermediate heat insulating material 54, both of through holes into which the shanks of the first coupling members 61 are to be inserted and through holes into which the shanks of the second coupling members 62 are to be inserted are formed so as to extend through the intermediate heat insulating material 54 in the plate thickness direction Z. Since the second intermediate plate member 42 is arranged between the first plate member 10 and the first intermediate plate member 41 in the plate thickness direction Z, the distance in the plate thickness direction Z between the first intermediate plate member 41 and the second intermediate plate member 42 is a third distance according to the plate thickness (the width in the plate thickness direction Z) of the intermediate heat insulating material 54 (a distance that is equal to or larger than the plate thickness of the intermediate heat insulating material 54) in a state where the first plate member 10 and the first intermediate plate member 41 are coupled to each other and the second plate member 20 and the second intermediate plate member 42 are coupled to each other. If the mechanical strength of the intermediate heat insulating material 54 is not enough to maintain the distance between the first intermediate plate member 41 and the second intermediate plate member 42, the distance between the first intermediate plate member 41 and the second intermediate plate member 42 may be kept at the third distance, for example, by using spacers (third spacers 73) for maintaining the distance between the first intermediate plate member 41 and the second intermediate plate member 42 as in the example shown in FIG. 4 described later.

Figure 3:
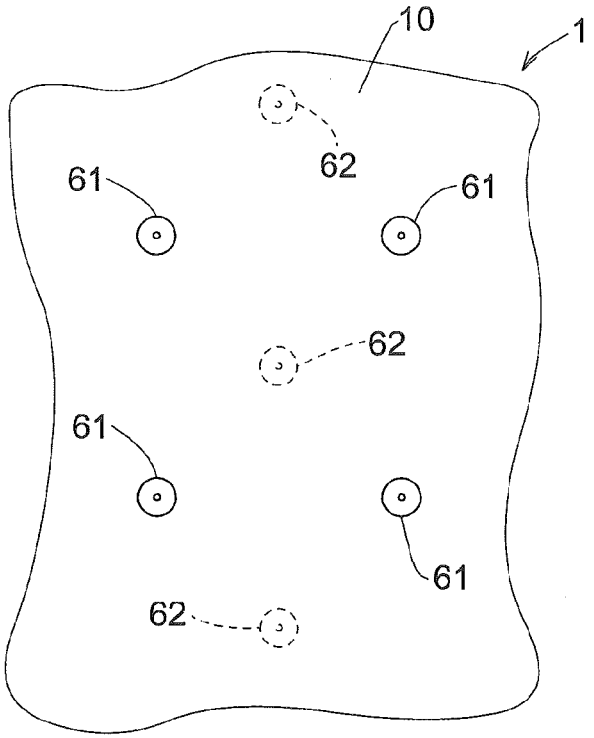
FIG. 3 is a plan view of part of the fire door according to the embodiment.

In order to properly ensure the heat shielding performance of the fire door 1, it is necessary to suppress formation of heat conductive paths having a low thermal resistance connecting the first plate member 10 and the second plate member 20. With regard to this aspect, as shown in FIGS. 1 and 2, the first coupling members 61 are arranged so as to be spaced away from all of the second plate member 20 and the second coupling members 62, the second coupling members 62 are arranged so as to be spaced away from the first plate member 10, and the first plate member 10 and the second plate member 20 are arranged so as to be spaced away from each other. Accordingly, heat conduction due to contact between the first plate member 10 and the second plate member 20 can be avoided, and formation of heat conductive paths having a low thermal resistance connecting the first plate member 10 and the second plate member 20, via the first coupling members 61 or the second coupling members 62, can be suppressed. As a result, the thermal resistance between the first plate member 10 and the second plate member 20 can be a relatively high value according to the thermal resistances of the first heat insulating material 51 and the second heat insulating material 52. Note that, in this embodiment, the first coupling members 61 and the second coupling members 62 are arranged so as not to be laid over each other as viewed in the plate thickness direction Z as shown in FIG. 3, so that the distance between the first coupling members 61 and the second coupling members 62 is properly ensured. In the example shown in FIG. 3, the plurality of first coupling members 61 are arranged on a square grid as viewed in the plate thickness direction Z, and the second coupling members 62 are respectively arranged at positions corresponding to the centers of the square grids (the centers of the squares) as viewed in the plate thickness direction Z, but, for example, a configuration is also possible in which the plurality of first coupling members 61 are arranged on a triangular grid as viewed in the plate thickness direction Z and the second coupling members 62 are respectively arranged at positions corresponding to the centers of the triangular grids (the centers of the triangles) as viewed in the plate thickness direction Z. Furthermore, a configuration is also possible in which at least part of the first coupling members 61 and the second coupling members 62 are irregularly arranged as viewed in the plate thickness direction Z.

In this embodiment, the intermediate member 30 is arranged so as to be spaced away from both of the first plate member 10 and the second plate member 20, so that the thermal resistance between the first plate member 10 and the second plate member 20 is improved. That is to say, formation of heat conductive paths having a low thermal resistance connecting the first plate member 10 and the second plate member 20, via the intermediate member 30, is avoided, so that the thermal resistance between the first plate member 10 and the second plate member 20 is improved. If the intermediate member 30 includes a heat insulating material (the intermediate heat insulating material 54) as in the fire door 1 according to this embodiment, the "intermediate member 30" in the context that the intermediate member 30 is arranged so as to be spaced away from both of the first plate member 10 and the second plate member 20 refers to the portion of the intermediate member 30 excluding the heat insulating material, or the entire intermediate member 30. In this embodiment, the entire intermediate member 30 is arranged so as to be spaced away from both of the first plate member 10 and the second plate member 20.

As shown in FIG. 2, the outer perimeter of the first plate member 10 is provided with a first extending portion 11 extending toward the second plate member 20 in the plate thickness direction Z. Furthermore, the outer perimeter of the second plate member 20 is provided with a second extending portion 21 extending toward the first plate member 10 in the plate thickness direction Z. That is to say, in this embodiment, both of the first extending portion 11 extending from the outer perimeter of the first plate member 10 toward the second plate member 20 in the plate thickness direction Z and the second extending portion 21 extending from the outer perimeter of the second plate member 20 toward the first plate member 10 in the plate thickness direction Z are provided. The first extending portion 11 and the second extending portion 21 are arranged so as to face each other in the plate thickness direction Z with a gap G interposed therebetween such that the first plate member 10 and the second plate member 20 are arranged so as to be spaced away from each other. In this embodiment, the position in the plate thickness direction Z of the gap G is a position in a region in the plate thickness direction Z between the first intermediate plate member 41 and the second intermediate plate member 42. The first heat insulating material 51, the second heat insulating material 52, and the intermediate member 30 are arranged on the inner side of the first extending portion 11 and the second extending portion 21 (the side toward the center of the fire door 1 along a plane that is orthogonal to the plate thickness direction Z). That is to say, the first heat insulating material 51, the second heat insulating material 52, and the intermediate member 30 are arranged in a region whose both sides in the plate thickness direction Z are defined by the flat plate portions of the first plate member 10 and the second plate member 20 and whose outer perimeter (outer perimeter in plan view) is defined by the first extending portion 11 of the first plate member 10 and the second extending portion 21 of the second plate member 20.

Each of the first intermediate plate member 41 and the second intermediate plate member 42 is arranged so as to be spaced away from both of the first plate member 10 and the second plate member 20. Specifically, the first intermediate plate member 41 is arranged so as to be spaced away, throughout the outer perimeter thereof, from the extending portion (the second extending portion 21, in this embodiment) in the direction that is orthogonal to the plate thickness direction Z, so that the first intermediate plate member 41 is arranged so as to be spaced away from both of the first plate member 10 and the second plate member 20. The second intermediate plate member 42 is arranged so as to be spaced away, throughout the outer perimeter thereof, from the extending portion (the first extending portion 11, in this embodiment) in the direction that is orthogonal to the plate thickness direction Z, so that the second intermediate plate member 42 is arranged so as to be spaced away from both of the first plate member 10 and the second plate member 20. Furthermore, the first intermediate through holes 94 into which the shanks of the first coupling members 61 are to be inserted are each formed so as to have a diameter larger than that of the shanks of the first coupling members 61 such that the second intermediate plate member 42 and the first coupling members 61 are not in contact with each other, and the second intermediate through holes 95 into which the shanks of the second coupling members 62 are to be inserted are each formed so as to have a diameter larger than that of the shanks of the second coupling members 62 such that the first intermediate plate member 41 and the second coupling members 62 are not in contact with each other. Accordingly, a high thermal resistance between the first plate member 10 and the first coupling members 61, and the second plate member 20 and the second coupling members 62 can be ensured. With the above-described configuration, formation of heat conductive paths having a low thermal resistance connecting the first plate member 10 and the second plate member 20, via the intermediate member 30, can be avoided.

Note that, as shown in FIG. 2, in this embodiment, the first heat insulating material 51, the second heat insulating material 52, and the intermediate heat insulating material 54 are also arranged so as to be spaced away, throughout the outer perimeter thereof, from the first extending portion 11 and the second extending portion 21 in the direction that is orthogonal to the plate thickness direction Z, as in the case of the first intermediate plate member 41 and the second intermediate plate member 42. A third heat insulating material 53 is arranged between the outer perimeters of the first heat insulating material 51, the second heat insulating material 52, and the intermediate member 30, and the extending portions (the first extending portion 11 and the second extending portion 21). The width in the plate thickness direction Z of the third heat insulating material 53 is set to a value according to the distance in the plate thickness direction Z between the first plate member 10 and the second plate member 20. Furthermore, the third heat insulating material 53 has a projection 55 that is formed so as to project outward in the direction that is orthogonal to the plate thickness direction Z (away from the center of the fire door 1) and is to be inserted into the gap G between the first extending portion 11 and the second extending portion 21. With the projection 55, contact between the first plate member 10 (the first extending portion 11) and the second plate member 20 (the second extending portion 21) can be more reliably avoided. As the third heat insulating material 53, a heat insulating material having a low thermal conductivity (having a high thermal resistance) is preferably used, and, for example, a heat insulating material made of the same material as and having the same structure as that of the first heat insulating material 51 and the second heat insulating material 52 may be used.

The fire door 1 as described above is provided, for example, so as to be capable of opening and closing opening portions formed in buildings, facilities, or the like. When a fire breaks out, spread of the fire via the opening portions can be suppressed by closing the opening portion with the fire door 1. Note that the fire door 1 may be used as a door member of a door in any form such as a hinged door, a sliding door, a folding door, or the like, and as a door member of a door configured by a plurality of door members. Furthermore, the fire door 1 can be provided at opening portions that are opened in any direction such as opening portions that are opened in the horizontal direction and opening portions that are opened in the vertical direction. For example, the fire door 1 may be used as a door member that slides in the horizontal direction for opening and closing an opening portion that is provided on the floor so as to open in the vertical direction.

Other Embodiments

Hereinafter, other embodiments of the fire door will be described. Note that the configurations disclosed in the following embodiments can be applied in combination with the configurations disclosed in other embodiments as long as no contradiction arises.

Figure 4:
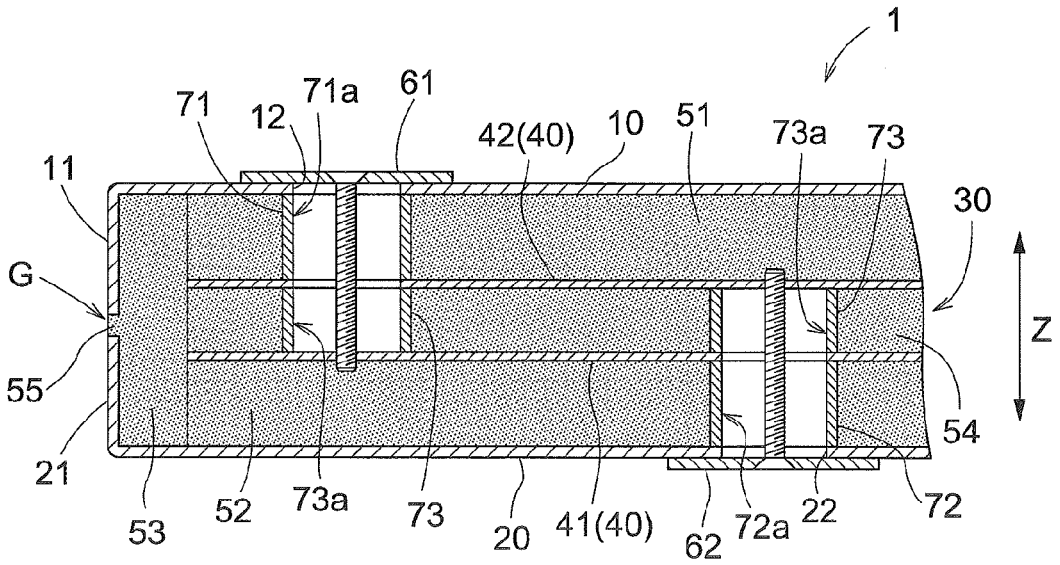
FIG. 4 is a cross-sectional view of part of the fire door according to another embodiment.

(1) In the foregoing embodiment, the configuration in which the distance in the plate thickness direction Z between the first plate member 10 and the intermediate member 30 is maintained using the first heat insulating material 51 and the distance in the plate thickness direction Z between the second plate member 20 and the intermediate member 30 is maintained using the second heat insulating material 52 was described as an example. However, there is no limitation to this configuration, and a configuration as shown in the example in FIG. 4 is also possible in which the fire door 1 includes first spacers 71 arranged between the first plate member 10 and the intermediate member 30 and second spacers 72 arranged between the second plate member 20 and the intermediate member 30. In this case, the distance in the plate thickness direction Z between the first plate member 10 and the intermediate member 30 can be maintained using the first spacers 71 without relying on the mechanical strength of the first heat insulating material 51, and the distance in the plate thickness direction Z between the second plate member 20 and the intermediate member 30 can be maintained using the second spacers 72 without relying on the mechanical strength of the second heat insulating material 52. Furthermore, in the foregoing embodiment, the configuration in which the distance in the plate thickness direction Z between two intermediate plate members 40 adjacent to each other in the plate thickness direction Z is maintained using the intermediate heat insulating material 54 was described as an example. However, there is no limitation to this configuration, and a configuration as shown in the example in FIG. 4 is also possible in which the fire door 1 includes third spacers 73 arranged between the two intermediate plate members 40 adjacent to each other in the plate thickness direction Z. In this case, the distance in the plate thickness direction Z between the two intermediate plate members 40 adjacent to each other in the plate thickness direction Z can be maintained using the third spacers 73 without relying on the mechanical strength of the intermediate heat insulating material 54. As the first spacers 71, the second spacers 72, and the third spacers 73, for example, spacers made of metal materials such as stainless steel and spacers made of ceramics may be used.

In the example shown in FIG. 4, the first spacers 71, the second spacers 72, and the third spacers 73 are each formed in the shape of a tube (in the shape of a cylinder, in this embodiment) extending in the plate thickness direction Z. The first coupling members 61 respectively extend through the spaces defined by inner circumferential faces (first inner circumferential faces 71*a*) of the first spacers 71, and the second coupling members 62 respectively extend through the spaces defined by inner circumferential faces (second inner circumferential faces 72*a*) of the second spacers 72. Furthermore, the first coupling members 61 and the second coupling members 62 respectively extend through the spaces defined by inner circumferential faces (third inner circumferential faces 73*a*) of the third spacers 73.

Specifically, the first spacers 71 are respectively fitted to the through holes into which the shanks of the first coupling members 61 are to be inserted, formed at the first heat insulating material 51, and the third spacers 73 are respectively fitted to the through holes into which the shanks of the first coupling members 61 are to be inserted, formed at the intermediate heat insulating material 54. The first coupling members 61 are arranged so as to extend through the first spacers 71 and the third spacers 73. The outer circumferential faces of the first spacers 71 are each formed so as to have a diameter larger than that of the first through holes 12 and the first intermediate through holes 94 (see FIG. 2), and the outer circumferential faces of the third spacers 73 through which the first coupling members 61 extend are each formed so as to have a diameter larger than that of the first intermediate through holes 94 (so as to have the same diameter as that of the first spacers 71, in the example shown in FIG. 4). In the example shown in FIG. 4, the inner circumferential faces of the first spacers 71 are each formed so as to have the same diameter as that of the first through hole 12 and the first intermediate through holes 94, but the inner circumferential faces of the first spacers 71 may be each formed so as to have a diameter larger than that of the first through holes 12 and the first intermediate through holes 94. Furthermore, in the example shown in FIG. 4, the inner circumferential faces of the third spacers 73 through which the first coupling members 61 extend are each formed so as to have the same diameter as that of the first intermediate through holes 94, but the inner circumferential faces of the third spacers 73 through which the first coupling members 61 extend may be each formed so as to have a diameter larger than that of the first intermediate through holes 94.

Furthermore, the second spacers 72 are respectively fitted to the through holes into which the shanks of the second coupling members 62 are to be inserted, formed at the second heat insulating material 52, and the third spacers 73 are respectively fitted to the through holes into which the shanks of the second coupling members 62 are to be inserted, formed at the intermediate heat insulating material 54. The second coupling members 62 are arranged so as to extend through the second spacers 72 and the third spacers 73. The outer circumferential faces of the second spacers 72 are each formed so as to have a diameter larger than that of the second through holes 22 and the second intermediate through holes 95 (see FIG. 2), and the outer circumferential faces of the third spacers 73 through which the second coupling members 62 extend are each formed so as to have a diameter larger than that of the second intermediate through holes 95 (so as to have the same diameter as that of the second spacers 72, in the example shown in FIG. 4). In the example shown in FIG. 4, the inner circumferential faces of the second spacers 72 are each formed so as to have the same diameter as that of the second through hole 22 and the second intermediate through holes 95, but the inner circumferential faces of the second spacers 72 may be each formed so as to have a diameter larger than that of the second through holes 22 and the second intermediate through holes 95.

Furthermore, in the example shown in FIG. 4, the inner circumferential faces of the third spacers 73 through which the second coupling members 62 extend are each formed so as to have the same diameter as that of the second intermediate through holes 95, but the inner circumferential faces of the third spacers 73 through which the second coupling members 62 extend may be each formed so as to have a diameter larger than that of the second intermediate through holes 95.

The spaces defined by the first inner circumferential faces 71*a* are hollow spaces without the first heat insulating material 51, the spaces defined by the second inner circumferential faces 72*a* are hollow spaces without the second heat insulating material 52, and the spaces defined by the third inner circumferential faces 73*a* are hollow spaces without the intermediate heat insulating material 54. Accordingly, contact between the first coupling members 61, and the first heat insulating material 51 and the intermediate heat insulating material 54 when assembling the fire door 1, and contact between the second coupling members 62, and the second heat insulating material 52 and the intermediate heat insulating material 54 when assembling the fire door 1 can be easily avoided.

The case in which the first spacers 71, the second spacers 72, and the third spacers 73 are each formed in the shape of a cylinder extending in the plate thickness direction Z was described as an example, but a configuration is also possible in which at least any one of the first spacers 71, the second spacers 72, and the third spacers 73 is formed in the shape of an angular tube or in the shape of a tube having a non-continuous portion in the circumferential direction. Furthermore, a configuration is also possible in which at least any one of the first spacers 71, the second spacers 72, and the third spacers 73 is formed, for example, in the shape extending in the plate thickness direction Z other than a tubular shape, such as an L as viewed in the plate thickness direction Z. In the foregoing embodiment, the configuration in which each of the first spacers 71, the second spacers 72, and the third spacers 73 is arranged so that a coupling member extends therethrough, but a configuration is also possible in which at least any one of the first spacers 71, the second spacers 72, and the third spacers 73 is arranged so that no coupling member extends therethrough. That is to say, a configuration is also possible in which the fire door 1 includes a spacer (the first spacers 71, the second spacers 72, or the third spacers 73) through which no coupling member extends.

Figure 5:
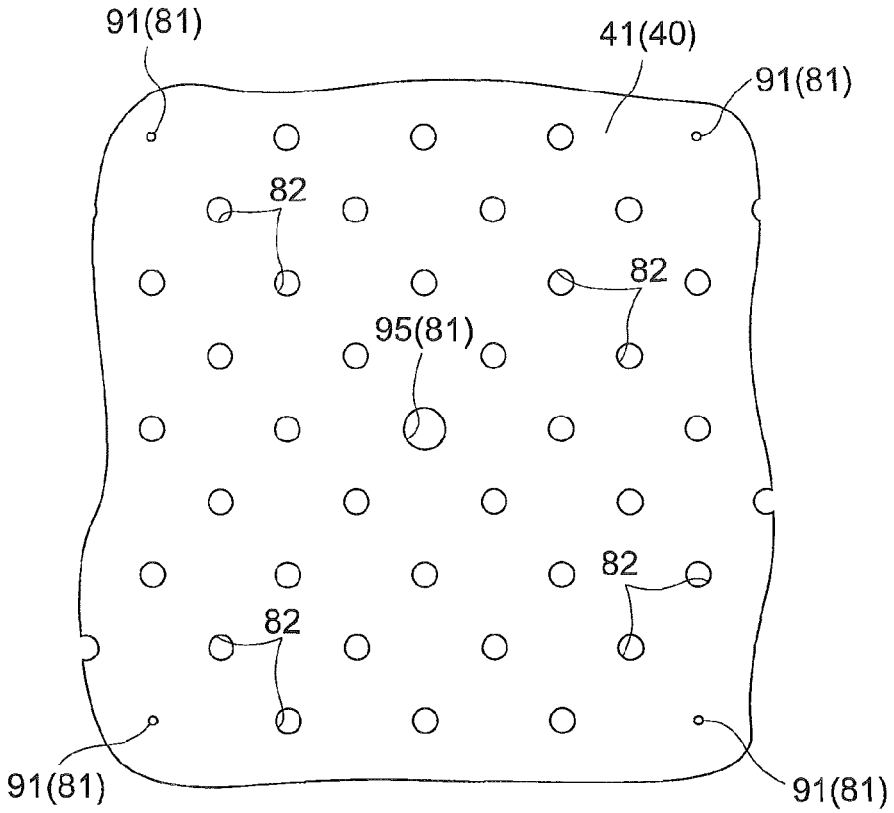
FIG. 5 is a plan view of part of an intermediate plate member according to another embodiment.

(2) In the foregoing embodiment, the configuration in which the first fastening holes 91 and the second intermediate through holes 95 are formed so as to extend through the first intermediate plate member 41 in the plate thickness direction Z and the second fastening holes 92 and the first intermediate through holes 94 are formed so as to extend through the second intermediate plate member 42 in the plate thickness direction Z was described as an example. Note that the first fastening holes 91 and the first intermediate through holes 94 are through holes through which the first coupling members 61 extend in the plate thickness direction Z, and the second fastening holes 92 and the second intermediate through holes 95 are through holes through which the second coupling members 62 extend in the plate thickness direction Z. That is to say, if through holes through which the first coupling members 61, the second coupling members 62, or third coupling members 63 (see FIG. 6) for coupling two intermediate plate members 40 extend in the plate thickness direction Z are taken as first through holes 81, all of the first fastening holes 91, the second fastening holes 92, the first intermediate through holes 94, and the second intermediate through holes 95 are the first through holes 81. However, there is no limitation to this configuration, and a configuration is also possible in which each of the first intermediate plate member 41 and the second intermediate plate member 42 includes a plurality of through holes consisting of the first through holes 81 and a second through hole 82 (preferably, a plurality of second through holes 82) different from the first through holes 81. FIG. 5 shows an example of the first intermediate plate member 41 having such a configuration. If the first intermediate plate member 41 and the second intermediate plate member 42 having such a configuration are used, the thermal resistance against heat conduction in a direction along the plate faces of both of the first intermediate plate member 41 and the second intermediate plate member 42 can be improved by the level corresponding to the second through holes 82 that are provided.

Figure 6:
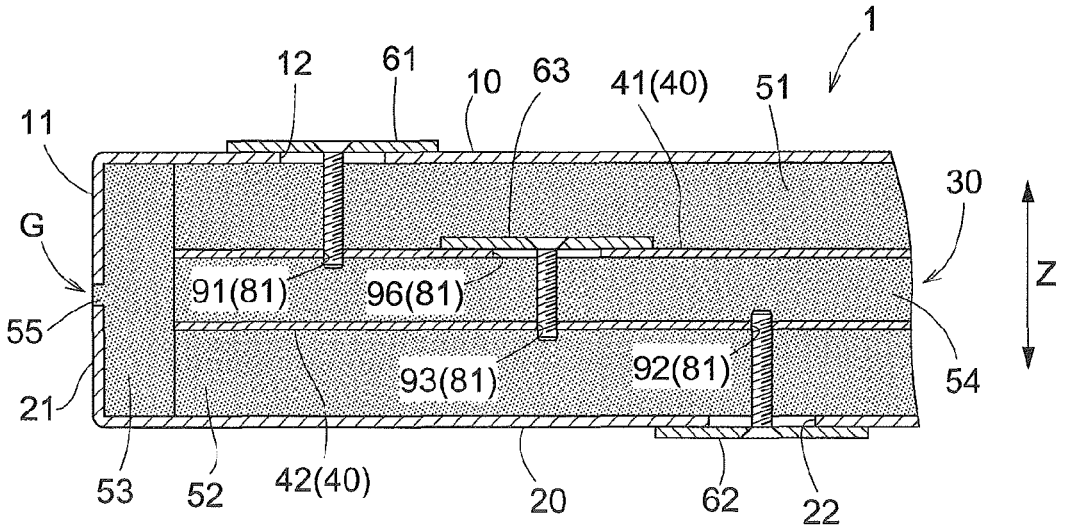
FIG. 6 is a cross-sectional view of part of the fire door according to another embodiment.

(3) In the foregoing embodiment, the configuration in which the second intermediate plate member 42 is arranged between the first plate member 10 and the first intermediate plate member 41 in the plate thickness direction Z was described as an example. However, there is no limitation to this configuration, and a configuration as shown in the example in FIG. 6 is also possible in which the first intermediate plate member 41 is arranged between the first plate member 10 and the second intermediate plate member 42 in the plate thickness direction Z. In this case, as shown in FIG. 6, the first plate member 10 and the second plate member 20 can be coupled to each other via the intermediate member 30, by using third coupling members 63 for coupling two intermediate plate members 40.

In the example shown in FIG. 6, each third coupling member 63 is a male screw including a head with a diameter larger than that of a third intermediate through hole 96 formed so as to extend through the first intermediate plate member 41 in the plate thickness direction Z, and a shank that is to be fastened to a third fastening hole 93 formed at the second intermediate plate member 42. In the intermediate heat insulating material 54, a through hole into which the shank of the third coupling member 63 is to be inserted is formed so as to extend through the intermediate heat insulating material 54 in the plate thickness direction Z, and the third coupling member 63 is fastened to the third fastening hole 93 in a state of being inserted into the third intermediate through hole 96 and the through hole formed through the intermediate heat insulating material 54 from the side opposite to the second heat insulating material 52 (the side opposite to the second plate member 20) in the plate thickness direction Z. The third intermediate through hole 96 and the third fastening hole 93 are the above-described first through holes 81. As the third coupling member 63, for example, coupling members made of metal materials such as stainless steel and coupling members made of ceramics may be used.

Note that, if the fire door 1 includes the first spacers 71, the second spacers 72, and the third spacers 73 described above (see FIG. 4) in the configuration in which the first intermediate plate member 41 is arranged between the first plate member 10 and the second intermediate plate member 42 in the plate thickness direction Z as in this example, a configuration is possible in which the third coupling members 63 respectively extend through the spaces defined by the third inner circumferential faces 73*a*, which are the inner circumferential faces of the third spacers 73.

Figure 7:
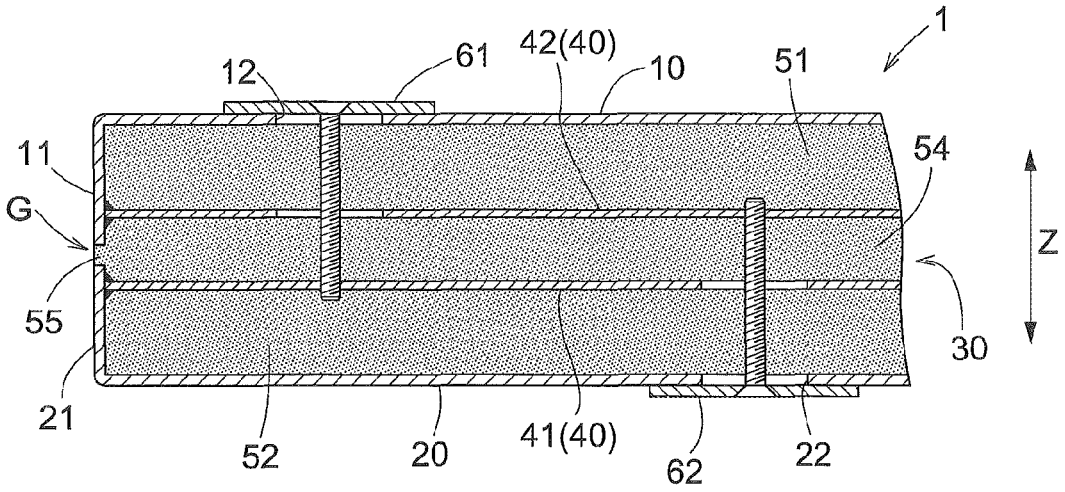
FIG. 7 is a cross-sectional view of part of the fire door according to another embodiment.

(4) In the foregoing embodiment, the configuration in which the intermediate member 30 is arranged so as to be spaced away from both of the first plate member 10 and the second plate member 20 was described as an example. However, there is no limitation to this configuration, and a configuration is also possible in which the intermediate member 30 is fixed, at the outer perimeter thereof, to at least one of the first extending portion 11 and the second extending portion 21. For example, a configuration as shown in the example in FIG. 7 is possible in which the outer perimeter of the first intermediate plate member 41 included in the intermediate member 30 is fixed to the second extending portion 21, and the outer perimeter of the second intermediate plate member 42 included in the intermediate member 30 is fixed to the first extending portion 11. The method for fixing the first intermediate plate member 41 and the second extending portion 21, and the method for fixing the second intermediate plate member 42 and the first extending portion 11 may be, for example, fixing by welding. Note that, in the example shown in FIG. 7, the intermediate heat insulating material 54 is provided with the projection 55 that is to be inserted into the gap G between the first extending portion 11 and the second extending portion 21.

Figure 8:
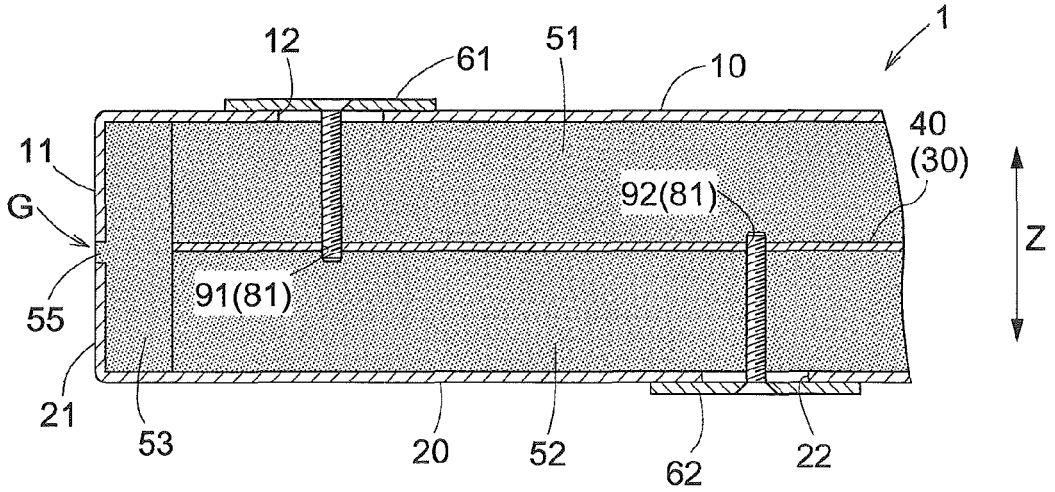
FIG. 8 is a cross-sectional view of part of the fire door according to another embodiment.

(5) In the foregoing embodiment, the configuration in which the intermediate member 30 includes two intermediate plate members 40 was described as an example. However, there is no limitation to this configuration, and a configuration is also possible in which the intermediate member 30 includes three or more intermediate plate members 40 or in which the intermediate member 30 includes only one intermediate plate member 40. In the latter configuration, the intermediate member 30 is configured by only one intermediate plate member 40. FIG. 8 shows an example of such a configuration. In this case, both of the first fastening hole 91 and the second fastening hole 92 are formed at the one intermediate plate member 40. Note that, in the configuration in which the intermediate member 30 includes only one intermediate plate member 40 as in this example, a configuration is also possible in which the fire door 1 includes the first spacers 71 and the second spacers 72 described above (see FIG. 4).

Figure 9:
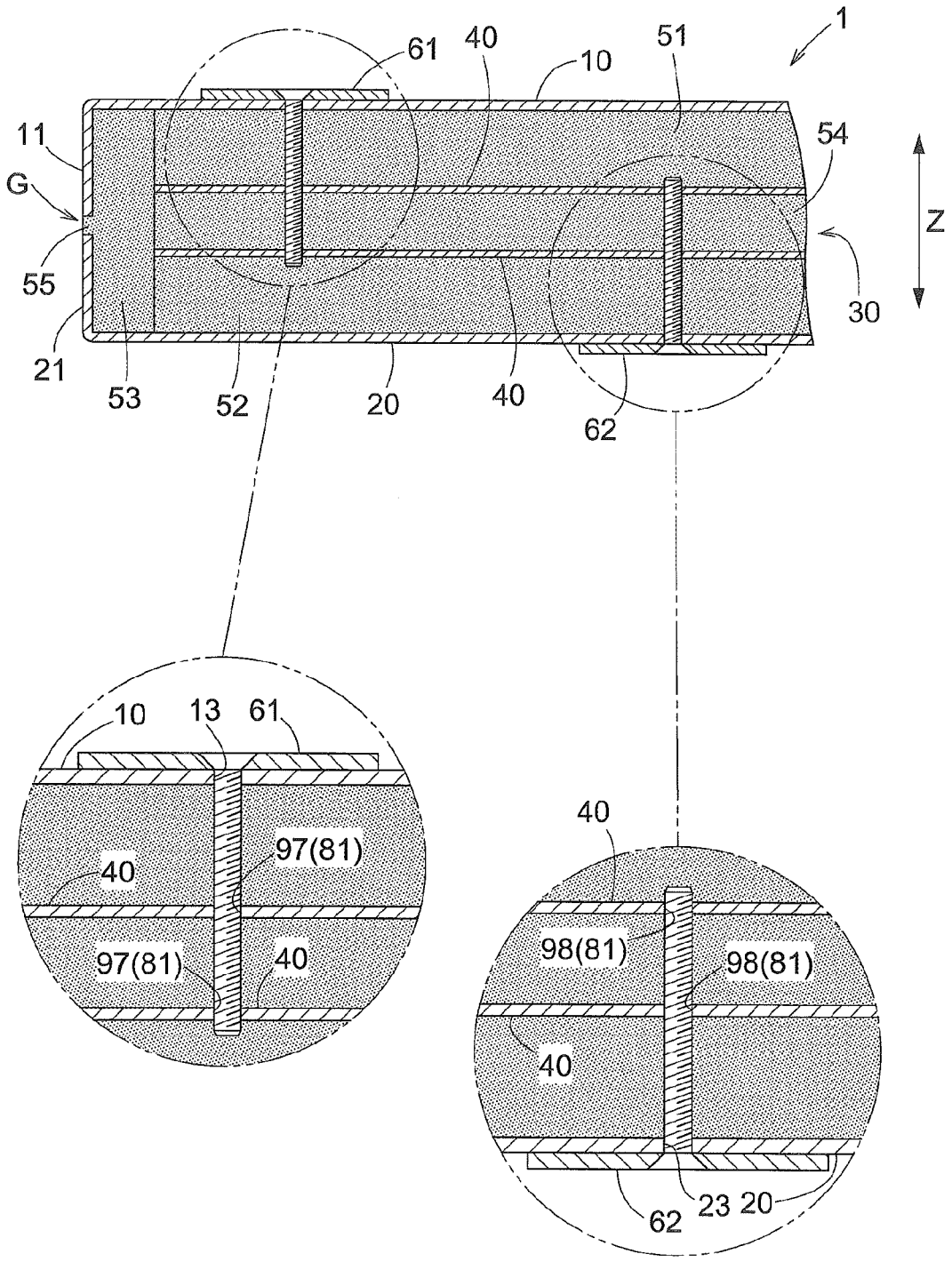
FIG. 9 is a cross-sectional view of part of the fire door according to another embodiment.

(6) In the foregoing embodiment, the configuration in which the portions of the first plate member 10 through which the shanks of the first coupling members 61 respectively extend in the plate thickness direction Z are provided with the first through holes 12 each with a diameter larger than that of the shanks, and the portions of the second plate member 20 through which the shanks of the second coupling members 62 respectively extend in the plate thickness direction Z are provided with the second through holes 22 each with a diameter larger than that of the shanks was described as an example. However, there is no limitation to this configuration, and a configuration is also possible in which the portions of the first plate member 10 through which the shanks of the first coupling members 61 respectively extend in the plate thickness direction Z and the portions of the second plate member 20 through which the shanks of the second coupling members 62 respectively extend in the plate thickness direction Z are provided with fastening holes (female screw holes) to which shanks of the coupling members are to be fastened (threaded). FIG. 9 shows an example of such a configuration. In the example shown in FIG. 9, the portions of the first plate member 10 through which the shanks of the first coupling members 61 respectively extend in the plate thickness direction Z are provided with sixth fastening holes 13 to which the shanks of the first coupling members 61 are to be fastened, and the portions of the second plate member 20 through which the shanks of the second coupling members 62 respectively extend in the plate thickness direction Z are provided with seventh fastening holes 23 to which the shanks of the second coupling members 62 are to be fastened.

Furthermore, in the foregoing embodiment, the configuration in which the first coupling members 61 each couple any one intermediate plate member 40 and the first plate member 10, and the second coupling members 62 each couple any one intermediate plate member 40 and the second plate member 20 was described as an example. However, there is no limitation to this configuration, and a configuration is also possible in which the first coupling members 61 each couple a plurality of intermediate plate members 40 and the first plate member 10, and the second coupling members 62 each couple a plurality of intermediate plate members 40 and the second plate member 20. For example, in the configuration in which the intermediate member 30 includes two intermediate plate members 40 as in the example shown in FIG. 9, a configuration is possible in which the first coupling members 61 each couple the two intermediate plate members 40 and the first plate member 10, and the second coupling members 62 each couple the two intermediate plate members 40 and the second plate member 20. In the example shown in FIG. 9, the portions of the two intermediate plate members 40 through which the shank of each first coupling member 61 extends in the plate thickness direction Z are respectively provided with fourth fastening holes 97 to which the shank of the first coupling member 61 is to be fastened, and the portions of the two intermediate plate members 40 through which the shank of each second coupling member 62 extends in the plate thickness direction Z are respectively provided with fifth fastening holes 98 to which the shank of the second coupling member 62 is to be fastened.

If the fastening holes to which the shanks of the first coupling members 61 are to be fastened are formed not only through one intermediate plate member 40 but also through the first plate member 10 and another intermediate plate member 40, the first plate member 10 and the intermediate member 30 can be more firmly coupled to each other by the first coupling members 61. In a similar manner, if the fastening holes to which the shanks of the second coupling members 62 are to be fastened are formed not only through one intermediate plate member 40 but also through the second plate member 20 and another intermediate plate member 40, the second plate member 20 and the intermediate member 30 can be more firmly coupled to each other by the second coupling members 62. As a result, the first plate member 10 and the second plate member 20 can be more firmly coupled to each other via the intermediate member 30, and the mechanical strength of the fire door 1 as a whole can be properly ensured.

(7) The configurations of the first coupling members 61 and the second coupling members 62 shown in the foregoing embodiment are merely an example, and the configurations of the first coupling members 61 and the second coupling members 62 can be changed as appropriate. In a similar manner, the configuration of the third coupling members 63 also can be changed as appropriate. For example, a configuration is possible in which each first coupling member 61 includes a male screw and a female screw (a member in the shape of a stepped cylinder whose inner circumferential face has a groove, etc.) that are inserted into the first heat insulating material 51 from the sides opposite to each other in the plate thickness direction Z, and the first plate member 10 and the intermediate member 30 are coupled to each other when the male screw and the female screw are threaded into each other. Furthermore, for example, instead of the configuration in which coupling members such as the first coupling members 61 are fastened to fastening holes formed at the intermediate plate members 40 through tapping (or burring and tapping) or the like, a configuration is also possible in which the coupling members are fastened to nuts fixed to the intermediate plate members 40 by welding or the like.

(8) In the foregoing embodiment, the configuration in which both of the first extending portion 11 extending from the outer perimeter of the first plate member 10 toward the second plate member 20 in the plate thickness direction Z and the second extending portion 21 extending from the outer perimeter of the second plate member 20 toward the first plate member 10 in the plate thickness direction Z are formed was described as an example. However, there is no limitation to this configuration, and a configuration is also possible in which only one of the first extending portion 11 and the second extending portion 21 is formed or in which none of the first extending portion 11 and the second extending portion 21 are formed. Furthermore, a configuration is also possible in which a member corresponding to the first extending portion 11, which is separate from the first plate member 10, is fixed to the first plate member 10 or in which a member corresponding to the second extending portion 21, which is separate from the second plate member 20, is fixed to the second plate member 20.

(9) In the foregoing embodiment, the configuration in which the first coupling members 61 and the second coupling members 62 are arranged so as not to be laid over each other as viewed in the plate thickness direction Z was described as an example, but a configuration is also possible in which the first coupling members 61 and the second coupling members 62 are arranged so as to be laid over each other as viewed in the plate thickness direction Z. For example, a configuration is possible in which the heads of the first coupling members 61 and the heads of the second coupling members 62 are arranged so as to be laid over each other as viewed in the plate thickness direction Z and the shanks of the first coupling members 61 and the shanks of the second coupling members 62 are arranged so as not to be laid over each other as viewed in the plate thickness direction Z.

(10) As described in the foregoing embodiment, as the first heat insulating material 51, the second heat insulating material 52, and the intermediate heat insulating material 54, heat insulating materials shaped into a plate shape may be used, but heat insulating materials at least having a certain level of flowability, such as gels or powders, may be used instead of the insulating materials shaped into a plate shape.

(11) It will be understood that, also regarding other configurations, the embodiments disclosed in this specification are merely an example in all aspects. Accordingly, those skilled in the art may modify these configurations in various ways as appropriate within the scope not departing from the gist of the present disclosure.

SUMMARY OF THE FOREGOING EMBODIMENT

Hereinafter, the summary of the above-described fire door will be described.

A fire door includes: a first plate member formed in the shape of a plate; a second plate member formed in the shape of a plate and arranged so as to be laid over the first plate member as viewed in a plate thickness direction; and an intermediate member formed in the shape of a plate and arranged between the first plate member and the second plate member; a first heat insulating material arranged between the first plate member and the intermediate member; a second heat insulating material arranged between the second plate member and the intermediate member; a first coupling member for coupling the first plate member and the intermediate member, arranged so as to extend through the first heat insulating material; and a second coupling member for coupling the second plate member and the intermediate member, arranged so as to extend through the second heat insulating material; wherein the first coupling member is arranged so as to be spaced away from both of the second plate member and the second coupling member, the second coupling member is arranged so as to be spaced away from the first plate member, and the first plate member and the second plate member are arranged so as to be spaced away from each other.

With this configuration, the first plate member is coupled by the first coupling member to the intermediate member, and the second plate member is coupled by the second coupling member to the intermediate member, and thus the first plate member and the second plate member can be coupled to each other via the intermediate member arranged therebetween, without using a direct coupling member for directly coupling the first plate member and the second plate member. That is to say, if a direct coupling member is used, the direct coupling member may be a thermal bridge between the first plate member and the second plate member, resulting in a decrease in the thermal resistance between the first plate member and the second plate member, and further in a decrease in the heat shielding performance of the fire door. However, with the above-described configuration, the first plate member and the second plate member can be coupled to each other without using such a direct coupling member. Furthermore, with the above-described configuration, the first coupling member is arranged so as to be spaced away from both of the second plate member and the second coupling member, and the second coupling member is arranged so as to be spaced away from the first plate member, and, moreover, the first plate member and the second plate member are arranged so as to be spaced away from each other. Accordingly, heat conduction due to contact between the first plate member and the second plate member can be avoided, and formation of heat conductive paths having a low thermal resistance connecting the first plate member and the second plate member, via the first coupling member or the second coupling member, can be suppressed. As a result, the thermal resistance between the first plate member and the second plate member can be a relatively high value according to the thermal resistances of the first heat insulating material and the second heat insulating material.

As described above, according to this configuration, the first plate member and the second plate member can be coupled to each other while ensuring a high thermal resistance between the first plate member and the second plate member, as a result of which it is possible to realize a fire door whose heat shielding performance can be properly ensured.

In this configuration, it is preferable that the fire door further includes: a first spacer arranged between the first plate member and the intermediate member and a second spacer arranged between the second plate member and the intermediate member, wherein each of the first spacer and the second spacer is formed in the shape of a tube extending in the plate thickness direction, the first coupling member extends through a space defined by an inner circumferential face of the first spacer, the second coupling member extends through a space defined by an inner circumferential face of the second spacer, and the intermediate member is arranged so as to be spaced away from both of the first plate member and the second plate member.

With this configuration, the distance in the plate thickness direction between the first plate member and the intermediate member can be maintained using the first spacer without relying on the mechanical strength of the first heat insulating material, and thus the first plate member and the intermediate member arranged with the first heat insulating material interposed therebetween can be firmly coupled to each other by the first coupling member. In a similar manner, the distance in the plate thickness direction between the second plate member and the intermediate member can be maintained using the second spacer without relying on the mechanical strength of the second heat insulating material, and thus the second plate member and the intermediate member arranged with the second heat insulating material interposed therebetween can be firmly coupled to each other by the second coupling member. As a result, the mechanical strength of the fire door as a whole can be properly ensured.

Furthermore, with this configuration, the intermediate member is arranged so as to be spaced away from both of the first plate member and the second plate member, resulting in an advantage that formation of heat conductive paths having a low thermal resistance connecting the first plate member and the second plate member, via the intermediate member, can be easily avoided.

Moreover, with this configuration, the first coupling member is arranged so as to extend through a space defined by an inner circumferential face of the first spacer, and the second coupling member is arranged so as to extend through a space defined by an inner circumferential face of the second spacer. Thus, with the configuration in which the first heat insulating material is not included in the space defined by the inner circumferential face of the first spacer, contact between the first coupling member and the first heat insulating material when assembling the fire door can be easily avoided. In a similar manner, with the configuration in which the second heat insulating material is not included in the space defined by the inner circumferential face of the second spacer, contact between the second coupling member and the second heat insulating material when assembling the fire door can be easily avoided. For example, if the coupling member (the first coupling member or the second coupling member) and the heat insulating material (the first heat insulating material or the second heat insulating material) are bought into contact with each other when assembling the fire door to the level that broken pieces of the heat insulating material are generated, the broken pieces may hinder assembling of the fire door, whereas, with this configuration, contact between the coupling member and the heat insulating material when assembling the fire door can be easily avoided, and thus it is possible to realize a fire door in which broken pieces of the heat insulating material are not generated during the assembly.

Alternatively, it is preferable that the fire door further includes: at least one of a first extending portion extending from an outer perimeter of the first plate member toward the second plate member in the plate thickness direction and a second extending portion extending from an outer perimeter of the second plate member toward the first plate member in the plate thickness direction, wherein the intermediate member is fixed, at an outer perimeter thereof, to at least one of the first extending portion and the second extending portion.

With this configuration, the outer perimeter of the intermediate member to which both of the first plate member and the second plate member are coupled is fixed to at least one of the first plate member (the first extending portion) and the second plate member (the second extending portion). Thus, the first plate member and the second plate member can be firmly coupled to each other via the intermediate member, and the mechanical strength of the fire door as a whole can be properly ensured.

In the thus configured fire door, it is preferable that the intermediate member includes a plurality of intermediate plate members, which are a plurality of members each formed in the shape of a plate, arranged so as to be spaced away from each other in the plate thickness direction, and an intermediate heat insulating material arranged between two intermediate plate members adjacent to each other in the plate thickness direction, the first coupling member couples a first intermediate plate member, which is one of the intermediate plate members, and the first plate member, and the second coupling member couples a second intermediate plate member, which is one intermediate plate member different from the first intermediate plate member, and the second plate member.

With this configuration, the first intermediate plate member to which the first plate member is coupled via the first coupling member and the second intermediate plate member to which the second plate member is coupled via the second coupling member are different intermediate plate members, and at least the intermediate heat insulating material among the intermediate heat insulating material and other intermediate plate members is arranged between the first intermediate plate member and the second intermediate plate member. Thus, compared with the case in which both of the first plate member and the second plate member are coupled to the same intermediate plate member, a high thermal resistance between the first plate member and the first coupling member, and the second plate member and the second coupling member can be easily ensured.

In this configuration, it is preferable that the second intermediate plate member is arranged between the first plate member and the first intermediate plate member in the plate thickness direction.

With this configuration, the position in the plate thickness direction of the second intermediate plate member relative to the first plate member and the first intermediate plate member can be fixed by coupling the first plate member to the first intermediate plate member using the first coupling member. Thus, the first plate member and the second plate member can be coupled to each other via the intermediate member, without using a coupling member for coupling the first intermediate plate member and the second intermediate plate member, and the configuration of the fire door can be simplified accordingly.

Furthermore, it is preferable that the fire door further includes: a third spacer arranged between the two intermediate plate members adjacent to each other in the plate thickness direction, wherein the third space is formed in the shape of a tube extending in the plate thickness direction, the first coupling member, the second coupling member, or a third coupling member for coupling the two intermediate plate members extends through a space defined by an inner circumferential face of the third spacer, and each of the first intermediate plate member and the second intermediate plate member is arranged so as to be spaced away from both of the first plate member and the second plate member.

With this configuration, the distance between two intermediate plate members adjacent to each other in the plate thickness direction can be maintained using the third spacer without relying on the mechanical strength of the intermediate heat insulating material, and thus it becomes easy to properly ensure the mechanical strength of the intermediate member as a whole.

Furthermore, with this configuration, each of the first intermediate plate member and the second intermediate plate member is arranged so as to be spaced away from both of the first plate member and the second plate member, resulting in an advantage that formation of heat conductive paths having a low thermal resistance connecting the first plate member and the second plate member, via the first intermediate plate member or the second intermediate plate member, can be easily avoided.

Moreover, with this configuration, the coupling member (the first coupling member, the second coupling member, or the third coupling member) is arranged so as to extend through a space defined by an inner circumferential face of the third spacer. Thus, with the configuration in which the intermediate heat insulating material is not included in the space defined by the inner circumferential face of the third spacer, contact between the coupling member and the intermediate heat insulating material when assembling the fire door can be easily avoided. For example, if the coupling member and the intermediate heat insulating material are bought into contact with each other when assembling the fire door to the level that broken pieces of the intermediate heat insulating material are generated, the broken pieces may hinder assembling of the fire door, whereas, with this configuration, contact between the coupling member and the intermediate heat insulating material when assembling the fire door can be easily avoided, and thus it is possible to realize a fire door in which broken pieces of the intermediate heat insulating material are not generated during the assembly.

Furthermore, it is preferable that each of the first intermediate plate member and the second intermediate plate member has a plurality of through holes including a first through hole through which the first coupling member, the second coupling member, or a third coupling member for coupling the two intermediate plate members extends in the plate thickness direction, and a second through hole different from the first through hole.

With this configuration, the thermal resistance against heat conduction in a direction along the plate faces of both of the first intermediate plate member and the second intermediate plate member can be improved by the level corresponding to the second through hole that is provided. Thus, formation of heat conductive paths having a low thermal resistance connecting the first plate member and the second plate member, via the first intermediate plate member or the second intermediate plate member, can be easily avoided.

In the thus configured fire door, it is preferable that the first coupling member and the second coupling member are arranged so as not to be laid over each other as viewed in the plate thickness direction.

With this configuration, the distance between the first coupling member and the second coupling member can be properly ensured, and formation of heat conductive paths having a low thermal resistance connecting the first plate member and the second plate member, via the first coupling member or the second coupling member, can be easily avoided.

What is claimed is:

1. A fire door comprising:

a first plate member formed in the shape of a plate;

a second plate member formed in the shape of a plate and arranged so as to be laid over the first plate member as viewed in a plate thickness direction;

an intermediate member formed in the shape of a plate and arranged between the first plate member and the second plate member;

a first heat insulating material arranged between the first plate member and the intermediate member;

a second heat insulating material arranged between the second plate member and the intermediate member;

a first coupling member for coupling the first plate member and the intermediate member, arranged so as to extend through the first heat insulating material; and a second coupling member for coupling the second plate member and the intermediate member, arranged so as to extend through the second heat insulating material;

wherein the first coupling member is arranged so as to be spaced away from both of the second plate member and the second coupling member, wherein the second coupling member is arranged so as to be spaced away from the first plate member, and wherein the first plate member and the second plate member are arranged so as to be spaced away from each other.

2. The fire door according to claim 1, further comprising:

a first spacer arranged between the first plate member and the intermediate member and a second spacer arranged between the second plate member and the intermediate member, wherein each of the first spacer and the second spacer is formed in the shape of a tube extending in the plate thickness direction, wherein the first coupling member extends through a space defined by an inner circumferential face of the first spacer, wherein the second coupling member extends through a space defined by an inner circumferential face of the second spacer, and wherein the intermediate member is arranged so as to be spaced away from both of the first plate member and the second plate member.

3. The fire door according to claim 1, further comprising:

at least one of a first extending portion extending from an outer perimeter of the first plate member toward the second plate member in the plate thickness direction and a second extending portion extending from an outer perimeter of the second plate member toward the first plate member in the plate thickness direction, and wherein the intermediate member is fixed to at least one of the first extending portion and the second extending portion.

4. The fire door according to claim 1, wherein the intermediate member includes a plurality of intermediate plate members, which are a plurality of members each formed in the shape of a plate, arranged so as to be spaced away from each other in the plate thickness direction, and an intermediate heat insulating material arranged between two intermediate plate members adjacent to each other in the plate thickness direction, wherein the first coupling member couples a first intermediate plate member, which is one of the intermediate plate members, and the first plate member, and wherein the second coupling member couples a second intermediate plate member, which is one intermediate plate member different from the first intermediate plate member, and the second plate member.

5. The fire door according to claim 4, wherein the second intermediate plate member is arranged between the first plate member and the first intermediate plate member in the plate thickness direction.

6. The fire door according to claim 4, further comprising:

a third spacer arranged between the two intermediate plate members adjacent to each other in the plate thickness direction, wherein the third space is formed in the shape of a tube extending in the plate thickness direction, wherein the first coupling member, the second coupling member, or a third coupling member for coupling the two intermediate plate members extends through a space defined by an inner circumferential face of the third spacer, and wherein each of the first intermediate plate member and the second intermediate plate member is arranged so as to be spaced away from both of the first plate member and the second plate member.

7. The fire door according to claim 4, wherein each of the first intermediate plate member and the second intermediate plate member has a plurality of through holes including a first through hole through which the first coupling member, the second coupling member, or a third coupling member for coupling the two intermediate plate members extends in the plate thickness direction, and a second through hole different from the first through hole.

8. The fire door according to claim 1, wherein the first coupling member and the second coupling member are arranged so as not to be laid over each other as viewed in the plate thickness direction.

* * * * *